US011534787B2

(12) United States Patent
Taube et al.

(10) Patent No.: US 11,534,787 B2
(45) Date of Patent: Dec. 27, 2022

(54) LIQUID DISTRIBUTION SYSTEM AND METHOD

(71) Applicant: J&R DESIGN SYSTEMS, INC., Bloomfield Hills, MI (US)

(72) Inventors: Frank Taube, Bloomfield Hills, MI (US); Chris Schweizer, Bloomfield Hills, MI (US); Richard D. Morgan, Harrodburg, KY (US)

(73) Assignee: J & R DESIGN SYSTEMS, INC., Bloomfield Hills, MI (US)

( * ) Notice: Subject to any disclaimer, the term of this patent is extended or adjusted under 35 U.S.C. 154(b) by 468 days.

(21) Appl. No.: 16/797,838

(22) Filed: Feb. 21, 2020

(65) Prior Publication Data

US 2020/0269268 A1 Aug. 27, 2020

Related U.S. Application Data

(60) Provisional application No. 62/809,807, filed on Feb. 25, 2019.

(51) Int. Cl.

| | |
|---|---|
| ***B05B 12/14*** | (2006.01) |
| ***B05B 12/08*** | (2006.01) |
| ***B05B 13/00*** | (2006.01) |

(52) U.S. Cl.

CPC ..... *B05B 12/149* (2013.01); *B05B 12/085* (2013.01); *B05B 13/00* (2013.01)

(58) Field of Classification Search

CPC ..... B05B 12/149; B05B 12/085; B05B 13/00; B05B 9/0423; F16L 2101/12; F16L 55/46

USPC ..... 427/421.1; 239/11

See application file for complete search history.

(56) References Cited

U.S. PATENT DOCUMENTS

| | | | | |
|---|---|---|---|---|
| 4,706,885 A | | 11/1987 | Morin | |
| 5,223,306 A | | 6/1993 | Bartow | |
| 5,853,027 A | * | 12/1998 | Winkel | B05B 12/149 251/30.01 |

(Continued)

OTHER PUBLICATIONS

Canadian Office Action dated May 20, 2021 from corresponding Canadian Patent Application No. 3,073,533, 5 pages.

(Continued)

*Primary Examiner* — Justin M Jonaitis

(74) *Attorney, Agent, or Firm* — Ohlandt, Greeley, Ruggiero and Perle, LLP

(57) ABSTRACT

A paint distribution system comprising a circulating pump configured to supply pressure to the system, in which the circulating pump has an input, configured to receive input data signals; a measuring device for measuring one or more parameters of a paint, in which the measuring device has an input, configured to receive input data signals, and has an output, configured to transmit output data signals, and in which the measuring device is positioned on a paint supply line in fluid communication with a paint color change assembly; and a controller having an input, configured to receive input data signals, and an output, configured to transmit output data signals. The output data signals from the controller are transmitted to the circulating pump to maintain or adjust circulating pump settings to control supply pressure to the system and maintain or adjust the parameters of the paint within a predetermined range.

18 Claims, 9 Drawing Sheets

(56) References Cited

U.S. PATENT DOCUMENTS

| | | | | |
|---|---|---|---|---|
| 7,293,720 | B2 * | 11/2007 | Ramsay | B05B 9/0403 118/313 |
| 2006/0177565 | A1 * | 8/2006 | Bhattacharya | B05B 9/0423 118/683 |
| 2009/0242657 | A1 * | 10/2009 | Peterson | A01M 7/0089 239/11 |
| 2010/0012025 | A1 * | 1/2010 | Herre | B05B 12/149 239/569 |
| 2016/0228901 | A1 * | 8/2016 | Hooper | G01F 1/00 |
| 2017/0197224 | A1 * | 7/2017 | Taube | F16L 55/46 |
| 2018/0368310 | A1 * | 12/2018 | Zimmerman | B05B 1/20 |
| 2021/0008583 | A1 * | 1/2021 | Smith | B05B 16/00 |

OTHER PUBLICATIONS

Bankert, Peter J.; "New Paint Circulation Pump Technology", Finishing '93 Conference and Exposition, Oct. 25-28, 1993, 10 pages.

Bankert, Peter J.; "Waterborne Paint Circulation", Finishing '95 Conference and Exposition, Sep. 18-21, 1995, 15 pages.

* cited by examiner

LIQUID DISTRIBUTION SYSTEM AND METHOD

CROSS-REFERENCED APPLICATIONS

This application claims the benefit of U.S. Provisional Application Ser. No. 62/809,807, filed Feb. 25, 2019, which is incorporated herein by reference in its entirety.

BACKGROUND

1. Field of the Disclosure

This disclosure relates to liquid distribution (e.g., circulation) systems, particularly to paint distribution (e.g., circulation) systems, and more particularly to automobile paint distribution (e.g., circulation) systems.

2. Description of the Related Art

The automobile industry uses highly automated and complex painting systems. A typical automobile plant is capable of painting multiple automobile body frames concurrently and consecutively with various paints as well as primers and protective coats. More than twenty (20) different colors may be used. The painting process needs to be efficient, reliable and of high quality. This requires a complex paint distribution/recirculation system that includes multiple paint reservoirs, pumps, filtration, long piping, color change stations with valves, hose assemblies going to spray stations and robot arms and elaborate computerized control system to choose and draw specific colors and amounts. Typical paint systems are described, for example, in U.S. Pat. Nos. 4,706,885, 5,223,306 and 7,293,720.

In such paint systems, the paint must be recirculated to suspend the particles which are in the paint. A minimum circulation velocity is required, typically from 0.3 feet per second to one (1) foot per second. The paint must be recirculated continuously even when not being used. The paint, as it is recirculated, shear is subjected to varying shear forces which impact viscosity and part quality.

Color is very important for automobile customers. Certain colors are very popular and others are not. But all are still needed. These non-popular or low runner colors still need circulation through the tubing. Because of their low usage, they have a much longer residence time in the system. These low usage colors or paints are vulnerable to what is termed as "shear degradation" that causes the color of the paint to shift. The high shear stress can cause pigments and flakes in metal paints to degrade over time with significant quality issues. See, for example, a paper by Peter Bankert of Graco at the "Finishing" conference and Exposition Cincinnati Ohio 1993 October Proceedings).

In addition to all the issues created by the current paint distribution designs, paint manufacturers are supplying paints (typically waterborne) over a wide range of viscosities. Viscosity specifications for the various different colored paints vary a lot resulting in a variety of viscosities and shear rates. FIG. 1 shows normalized viscosity versus normalized shear rate graphs for four (4) typical paints. One can clearly see a significant variation in the paint viscosities. Paint distribution system designers are challenged with designing pumps, valves and piping to satisfy a range of viscosities. Operating parameters such as flow, supply pressure and back pressure will be specific for each paint color. Other issues like shear degradation and solids settling will occur if operating parameters are not correct. This will cause defects on the automotive vehicles and could require work stoppage, vehicle repair and intensive cleaning of the plugged hoses and pipes.

As indicated, all the tubing and hosing for the current paint distribution systems is quite long (e.g., several hundred feet and some as long as 1000 feet or more). Even the drops in the spray station box are quite a distance away from each other. The current paint distribution systems must provide minimum required fluid pressure and flow at all drops. As the paint flows through the tubing, the friction naturally causes a pressure drop. This pressure drop must be accounted for in order to satisfy the pressure specification for the robot color change assembly 210. The pressure drop is calculated by the following formula:

$$\text{Delta } P = A*(QVL/D^4)$$

where Delta P (psi) is pressure change, Q (gpm) is flow rate of the paint, V (poise) is viscosity, L (feet) is length of the pipe, D (inch) is inside diameter of the pipe, and A is constant.

For example, if the drop points are one hundred (100) feet apart and Q is 2 gpm, V is 1 poise, D is 1 inch and A is 0.0273, then Delta P is 5.46 psi.

Because the current paint distribution system pipes can be several hundred feet long, significant pressure loss is expected. So the supply line fluid pressure must be significantly higher than the required fluid pressure at the color change assemblies. This requires different pump specifications for all the lines.

The pressure drop is directly related to paint viscosities. FIG. 1 shows that different paint colors have varying paint viscosities. This means each color line will have different Delta P requiring wide range of pump pressures.

Paint velocity is another important consideration. The paint must maintain a certain velocity in all the pipes and hoses. If the velocity is low, then the paint will settle causing cosmetic quality issues on the automobile body. Settling can also lead to clogged lines over time. To maintain velocity, "graduated" pipe sizes are required that are designed to system requirements.

If the velocity is too high, then it can lead to shear degradation issues. Shear can be looked at as to how many turns of paint can be accomplished through the paint distribution system without seeing a color degradation. About one thousand (1000) turns is a good design number without color impact. If the system design requires higher fluid pressure and high fluid flow rates, then it will cause high shear points and thus reduced number of paint turns.

The current paint distribution designs must address many issues including: paint shear/degradation (e.g., varying system flow rates, supply and return pressures); paint viscosities (e.g., wide range of paint viscosities requiring high supply pressures and challenge to meet velocity demands throughout the paint distribution system); and system balancing with a minimum circulation velocity (e.g., fluid pressure and fluid flow requirements not consistent due to paint shear and paint viscosity differences).

These issues result in serious yield, quality and cost disadvantages for the automobile industry.

Accordingly, there is a need for improved paint distribution systems, particularly suited for automotive paint distribution lines. There is a need for improved paint distribution systems having a design that offers real time monitoring of the paint velocity, and feedback to a control system to automatically adjust the pump settings to control the supply pressure, and therefore the velocity of the paint. This real time monitoring would provide for a controlled shear rate which controls the paint color and viscosity, and thereby improves vehicle quality. Further, there is a need for improved paint distribution systems that afford yield, quality and cost advantages, in particular, for the automobile industry.

The present disclosure provides many advantages, which shall become apparent as described below.

SUMMARY

This disclosure provides, in general, unique liquid distribution (e.g., circulation) systems, particularly paint distribution (e.g., circulation) systems, and more particularly automobile paint distribution (e.g., circulation) systems.

This disclosure provides an improved paint distribution system, in particular, a paint distribution system having a measuring device, e.g., flowmeters, added to all drops or one (1) specific drop of a hydraulically balanced two pipe system. This improvement allows real time monitoring of the paint velocity, and feedback to a control system to automatically adjust the pump settings to control the supply pressure, and therefore the velocity of the paint. This real time monitoring provides for a controlled shear rate which controls the paint color and viscosity, and thereby improves vehicle quality.

In particular, this disclosure provides a unique liquid distribution system particularly suited for automotive paint distribution lines.

This disclosure also relates in part to a method for supplying a paint for coating of a workpiece. The method comprises providing a paint distribution system comprising: at least one paint reservoir; at least one hydraulically balanced or graduated paint circulation system.

This design will allow easy balance of the system at the minimum velocity required for special purpose equipment (SPE) and supply pressure.

This design by accurately controlling velocity controls the shear rate and color of the paint.

This design allows for the manual or automatic adjustment of the pump to maintain the desired velocity.

This disclosure also relates in part to a paint distribution system comprising: at least one paint reservoir; at least one spray station paint assembly; a plurality of paint circulation lines disposed between the paint reservoir and the spray station paint assembly; at least one paint color change assembly; a plurality paint supply lines in fluid communication between the spray station paint assembly and the paint color change assembly; at least one circulating pump configured to supply flow and pressure to the paint distribution system, in which the circulating pump has at least one input, configured to receive input data signals; at least one measuring device for measuring one or more parameters of a paint, in which the measuring device has at least one input, configured to receive input data signals, and has at least one output, configured to transmit output data signals, and in which the measuring device is positioned on a paint supply line in fluid communication with a paint color change assembly; and one or more controllers having at least one input, configured to receive input data signals, and at least one output, configured to transmit output data signals. One or more output data signals are transmitted from the measuring device to the controller. The controller generates one or more output data signals based on one or more input data signals received from the measuring device. The output data signals from the controller are transmitted to the circulating pump to maintain or adjust circulating pump settings to control supply pressure to the paint distribution system, and thereby maintain or adjust the one or more parameters of the paint within a predetermined range in real time.

This disclosure further relates, in part, to a paint distribution system comprising: at least one paint reservoir; and at least one hydraulically balanced or graduated paint circulation system. The at least one hydraulically balanced or graduated paint circulation system comprises: at least one circulating pump configured to supply pressure to the paint distribution system, in which the circulating pump has at least one input, configured to receive input data signals; at least one measuring device for measuring one or more parameters of a paint, in which the measuring device has at least one input, configured to receive input data signals, and has at least one output, configured to transmit output data signals; and one or more controllers having at least one input, configured to receive input data signals, and at least one output, configured to transmit output data signals. One or more output data signals are transmitted from the measuring device to the controller. The controller generates one or more output data signals based on one or more input data signals received from the measuring device. The output data signals from the controller are transmitted to the circulating pump to maintain or adjust circulating pump settings to control supply pressure to the paint distribution system, and thereby maintain or adjust the one or more parameters of the paint within a predetermined range in real time.

This disclosure also relates, in part, to a method for supplying a paint for coating of a workpiece. The method comprises: a) providing a paint distribution system; b) circulating one or more colored paints through the paint distribution system; and c) coating the workpiece with the one or more colored paints. The paint distribution system comprises: at least one paint reservoir; at least one spray station paint assembly; a plurality of paint circulation lines disposed between the paint reservoir and the spray station paint assembly; at least one paint color change assembly; a plurality paint supply lines in fluid communication between the spray station paint assembly and the paint color change assembly; at least one circulating pump configured to supply pressure to the paint distribution system, in which the circulating pump has at least one input, configured to receive input data signals; at least one measuring device for measuring one or more parameters of a paint, in which the measuring device has at least one input, configured to receive input data signals, and has at least one output, configured to transmit output data signals, and in which the measuring device is positioned on a paint supply line in fluid communication with a paint color change assembly; and one or more controllers having at least one input, configured to receive input data signals, and at least one output, configured to transmit output data signals. One or more output data signals are transmitted from the measuring device to the controller. The controller generates one or more output data signals based on one or more input data signals received from the measuring device. The output data signals from the controller are transmitted to the circulating pump to maintain or adjust circulating pump settings to control supply pressure to the paint distribution system, and thereby maintain or adjust the one or more parameters of the paint within a predetermined range in real time.

This disclosure further relates, in part, to a method for supplying a paint for coating of a workpiece. The method comprises: a) providing a paint distribution system; b) circulating one or more colored paints through the paint distribution system; and c) coating the workpiece with the one or more colored paints. The paint distribution system comprises: at least one paint reservoir; and at least one hydraulically balanced or graduated paint circulation system. The at least one hydraulically balanced or graduated paint circulation system comprises: at least one circulating pump configured to supply pressure to the paint distribution system, in which the circulating pump has at least one input, configured to receive input data signals; at least one measuring device for measuring one or more parameters of a paint, in which the measuring device has at least one input, configured to receive input data signals, and has at least one output, configured to transmit output data signals; and one or more controllers having at least one input, configured to receive input data signals, and at least one output, configured to transmit output data signals. One or more output data signals are transmitted from the measuring device to the controller. The controller generates one or more output data signals based on one or more input data signals received from the measuring device. The output data signals from the controller are transmitted to the circulating pump to maintain or adjust circulating pump settings to control supply pressure to the paint distribution system, and thereby maintain or adjust the one or more parameters of the paint within a predetermined range in real time.

This disclosure yet further relates, in part, to a paint distribution system comprising: at least one paint reservoir; at least one spray station paint assembly; a plurality of paint circulation lines disposed between the paint reservoir and the spray station paint assembly; at least one paint color change assembly; a plurality paint supply lines in fluid communication between the spray station paint assembly and the paint color change assembly; at least one circulating pump configured to supply flow and pressure to the paint distribution system; and at least one measuring device for measuring one or more parameters of a paint, in which the measuring device is positioned on a paint supply line in fluid communication with a paint color change assembly. The measuring device is visually monitored by an operator. The circulating pump is adjusted manually by the operator based on data from the measuring device. The operator maintains or adjusts manually circulating pump settings to control supply flow and pressure to the paint distribution system, and thereby maintain or adjust the one or more parameters of the paint within a predetermined range.

This disclosure also relates, in part, to a paint distribution system comprising: at least one paint reservoir; and at least one hydraulically balanced or graduated paint circulation system. The at least one hydraulically balanced or graduated paint circulation system comprises: at least one circulating pump configured to supply pressure to the paint distribution system; and at least one measuring device for measuring one or more parameters of a paint. The measuring device is visually monitored by an operator. The circulating pump is adjusted manually by the operator based on data from the measuring device. The operator maintains or adjusts manually circulating pump settings to control supply flow and pressure to the paint distribution system, and thereby maintain or adjust the one or more parameters of the paint within a predetermined range.

This disclosure further relates, in part, to a method for supplying a paint for coating of a workpiece. The method comprises: a) providing a paint distribution system; b) circulating one or more colored paints through the paint distribution system; and c) coating the workpiece with the one or more colored paints. The paint distribution system comprises: at least one paint reservoir; at least one spray station paint assembly; a plurality of paint circulation lines disposed between the paint reservoir and the spray station paint assembly; at least one paint color change assembly; a plurality paint supply lines in fluid communication between the spray station paint assembly and the paint color change assembly; at least one circulating pump configured to supply pressure to the paint distribution system; and at least one measuring device for measuring one or more parameters of a paint, in which the measuring device is positioned on a paint supply line in fluid communication with a paint color change assembly. The measuring device is visually monitored by an operator. The circulating pump is adjusted manually by the operator based on data from the measuring device. The operator maintains or adjusts manually circulating pump settings to control supply flow and pressure to the paint distribution system, and thereby maintain or adjust the one or more parameters of the paint within a predetermined range.

This disclosure yet further relates, in part, to a method for supplying a paint for coating of a workpiece. The method comprises: a) providing a paint distribution system; b) circulating one or more colored paints through the paint distribution system; and c) coating the workpiece with the one or more colored paints. The paint distribution system comprises: at least one paint reservoir; and at least one hydraulically balanced or graduated paint circulation system. The at least one hydraulically balanced or graduated paint circulation system comprises: at least one circulating pump configured to supply pressure to the paint distribution system; and at least one measuring device for measuring one or more parameters of a paint. The measuring device is visually monitored by an operator. The circulating pump is adjusted manually by the operator based on data from the measuring device. The operator maintains or adjusts manually circulating pump settings to control supply flow and pressure to the paint distribution system, and thereby maintain or adjust the one or more parameters of the paint within a predetermined range.

Several advantages are afforded by the paint distribution system design of this disclosure including, for example, instantaneous (real time) flow rate/velocity/shear rate feedback; ability to alarm based on low or high flow rate/velocity/shear rate to prevent settling and excessive shear and degradation; and ability to close loop pump control to manually or automatically set a paint circulation system pump flow rate, supply pressure and return pressure (back pressure) to meet velocity/shear rate requirements.

Further objects, features and advantages of the present disclosure will be understood by reference to the following drawings and detailed description.

DETAILED DESCRIPTION OF THE PREFERRED EMBODIMENTS

Figure 1:
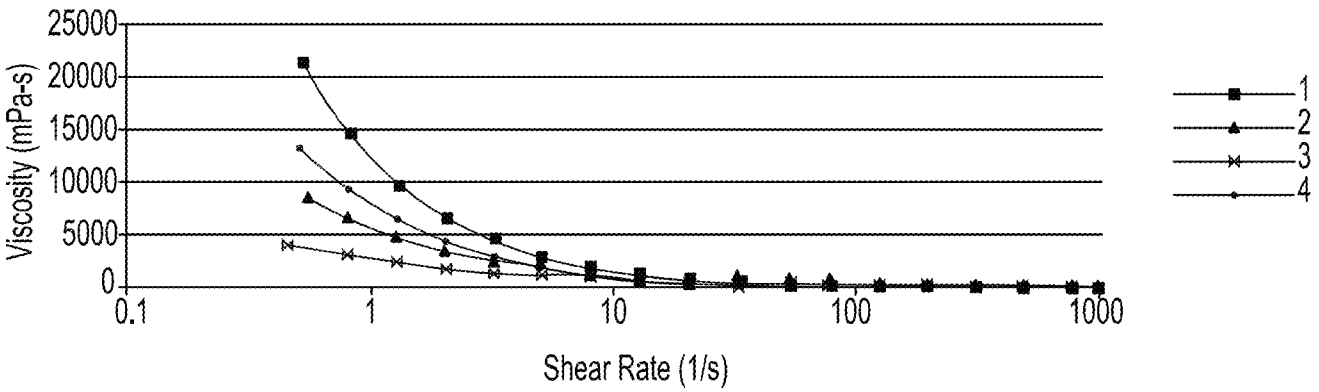
FIG. 1 depicts paint viscosities versus shear rate curves for four (4) typical paints.

The present disclosure provides a paint distribution system which is particularly suited for a multiple station paint spray operation. The system includes a reservoir of paint, a piping system having an inlet and outlet both of which are open to the reservoir, a circulating pump, a measuring device (e.g., flow meter, pressure transmitter, etc.), and a programmable logic controller (PLC). Alternatively, with no PLC, circulating pump settings can be maintained or adjusted manually to control supply flow and pressure to the paint distribution system, and thereby maintain or adjust one or more parameters of the paint within a predetermined range. The circulating pump pumps the paint from the inlet and towards the outlet while a plurality of paint drops, for example paint spray guns, are provided along the piping system at spaced intervals.

In an embodiment, paints useful in this disclosure include solids (metallic flake, mica and xirallic) for metallic and pearlescent finishes. The paint must be agitated and circulated to keep the solids in suspension. Waterborne basecoat paints are typically circulated at a minimum velocity of 0.5 ft./sec. to maintain solids suspension. If paint does not circulate properly, the solids will settle and accumulate, and will be dispensed with the paint, creating defects (dirt/seeds) in the final paint finish. These defects impact quality and must be taken offline for repair/reprocess. The paint distribution system of this disclosure corrects and prevents these defects, thereby affording a major benefit to the paint finishing industry.

Excessive shear/degradation of base coat paints impact the solids, causing them to deform/bend. This can be caused by circulating paints at an excessive flow rate/velocity. This changes the reflection/refraction characteristics of the paint, and causes the color to shift or change over time. Such problem requires finished products to be scrapped or reprocessed. The paint distribution system of this disclosure corrects and prevents this problem, thereby affording a major benefit to the paint finishing industry.

Waterborne paints are typically viscosity sensitive based on shear rate (the higher the shear rate the lower the viscosity). For some waterborne paints, the final product appearance can be improved if the material is dispensed at a specific viscosity range. This requires the spray station drops to be controlled to a specific flow rate/velocity/shear rate range. The paint distribution system of this disclosure provides for spray station drops to be controlled to a specific flow rate/velocity/shear rate range, thereby affording a major benefit to the paint finishing industry.

The paint distribution system design of this disclosure provides instantaneous (real time) flow rate/velocity/shear rate feedback. Also, the paint distribution system design of this disclosure provides the ability to alarm based on low or high flow rate/velocity/shear rate to prevent settling and excessive shear and degradation. Further, the paint distribution system design of this disclosure provides the ability to close loop pump control to manually or automatically set a paint circulation system pump flow rate, supply pressure and return pressure (back pressure) to meet velocity/shear rate requirements.

Based in the shear rate/viscosity characteristics of paint distribution system parts, flow rates and pressures can vary greatly to meet minimum velocity requirements. This disclosure provides a method to measure flow rate at a specific spray station to allow pump flow and pressure requirements to be determined. Once determined, pump flow and pressure can be adjusted manually or automatically (real time) to meet velocity requirements. Proper velocity will improve paint quality and paint life.

Figure 2:
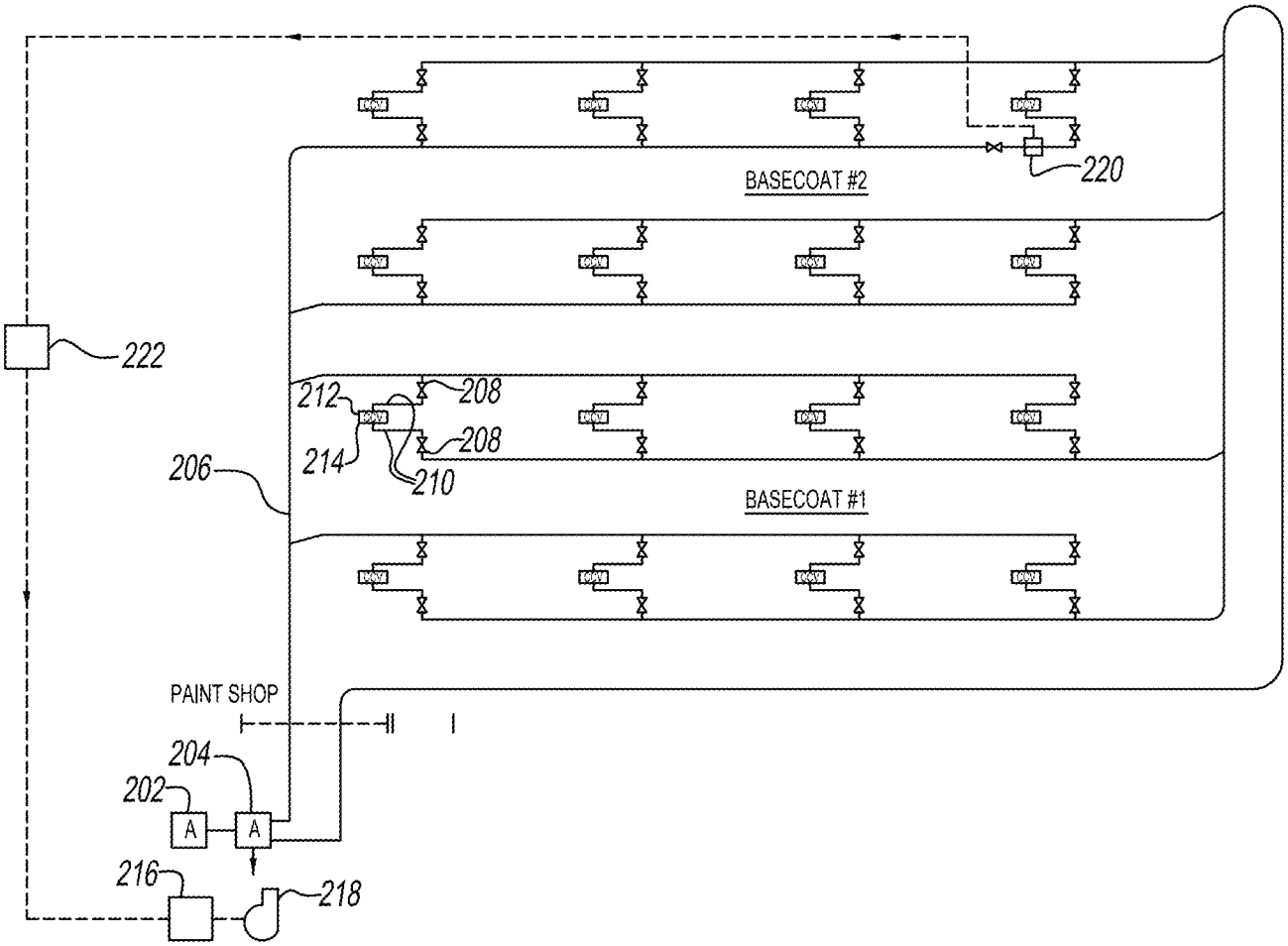
FIG. 2 depicts a paint distribution system of this disclosure showing paint supply, circulating pump, flow meter, and programmable logic controller (PLC).
Figure 3:
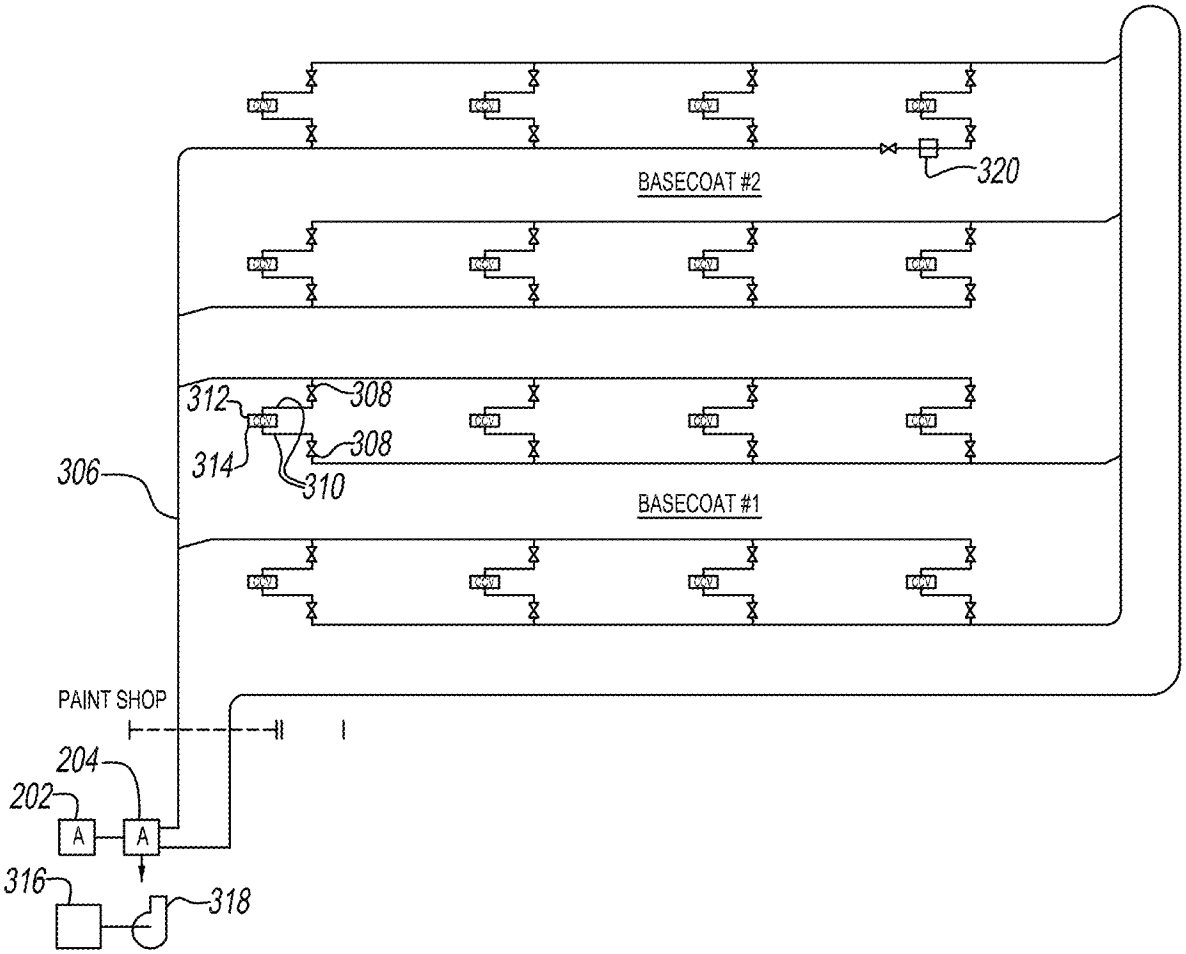
FIG. 3 depicts a paint distribution system of this disclosure showing paint supply, circulating pump, and flow meter, in which circulating pump settings are maintained or adjusted manually to control supply flow and pressure to the paint distribution system.

Paint distribution systems of this disclosure are shown in FIGS. 2 and 3. Generally, different color paints are stored in individual reservoirs 202 and day tanks 204 in a room (called mix room) away from the spray booths or stations. The main reason to keep the mix room away from the spray stations is that many paints are solvent based and flammable. Mix rooms are designed as explosion proof and rated Class 1/Division 1 areas with stringent restrictions based on safety and environmental needs. This need necessitates long piping network from the tanks to the spray stations. Each tank generally has one (1) supply line and a return line. The two (2) pipe design (one supply line and one return line) is the most commonly used in the industry (see, for example, U.S. Pat. No. 4,706,885).

FIG. 2 shows a paint distribution system for one (1) color and two (2) parallel booths working simultaneously (i.e., two base coats #1 and #2) with each booth having eight (8) color change valves 214 for a total of 16 color change valves 214 at each spray robot arms 212. The supply line 206 may include a heat exchange to control the paint temperature and the supply lines and return lines. The paint is continuously circulated from and back to the tank 204. As stated, there are many drops at the spray booths, where paint is drawn from the supply line whenever needed. From the supply line 206, thru the valves 208, paint is drawn as needed by the hoses 210. Thus multiple tubes and hoses run from the supply line to the robot's color change valves (CCV) at 214.

The paint distribution system includes a motor 216, circulating pump 218, a flow meter 220 located at a specific distant drop on a supply line, and a programmable logic controller (PLC) 222. The PLC 222 has a logic system that provides control of one or more parameters of the paint within a predetermined range in real time. The one or more parameters include one or more of velocity, flow rate, shear rate, temperature or pressure values for the paint in the paint distribution system.

The PLC 222 manages the circulating pump 218 function. The PLC 222 can also be interfaced with other components for managing the paint distribution system operations.

Optionally, a proportional-integral-derivative (PID) controller can be used. The control can be stand alone, in the pump controller, or a PLC.

Referring to FIG. 2, the PLC 222 is provided for pressure supply to the paint distribution system. The PLC 222 receives a signal from the flow meter 220 containing measurements of one or more parameters of a paint in the paint distribution system. The PLC 222 sends a signal to the circulating pump 218 to maintain or adjust circulating pump settings to control supply pressure to the paint distribution system. Next signal the PLC 222 sends to the flow meter 220 is that it is ready to accept new measurements of paint parameters. The PLC 222 receives a signal from the flow meter 220 containing new measurements of one or more parameters of a paint in the paint distribution system. The PLC 222 sends a signal to the circulating pump 218 to maintain or adjust circulating pump settings to control supply pressure to the paint distribution system. The PLC 222 has a logic system that provides continuous control of one or more parameters of the paint within a predetermined range in real time.

FIG. 3 shows a paint distribution system for one (1) color and two (2) parallel booths working simultaneously (i.e., two base coats #1 and #2) with each booth having eight (8) color change valves 314 for a total of 16 color change valves 314 at each spray robot arms 312. The supply line 306 may include a heat exchange to control the paint temperature and the supply lines and return lines. The paint is continuously circulated from and back to the tank 204. As stated, there are many drops at the spray booths, where paint is drawn from the supply line whenever needed. From the supply line 306, thru the valves 308, paint is drawn as needed by the hoses 310. Thus multiple tubes and hoses run from the supply line to the robot's color change valves (CCV) at 314.

The paint distribution system includes a motor 316, circulating pump 318, and a flow meter 320 located at a specific distant drop on a supply line. The motor 316 and circulating pump 318 can be a pneumatic, hydraulic or electric motor/pump. The flow meter 320 is visually monitored by an operator. The circulating pump 318 is adjusted manually by the operator based on data from the flow meter 320. The operator maintains or adjusts manually circulating pump settings to control supply flow and pressure to the paint distribution system, and thereby maintain or adjust the one or more parameters of the paint within a predetermined range.

Figure 4:
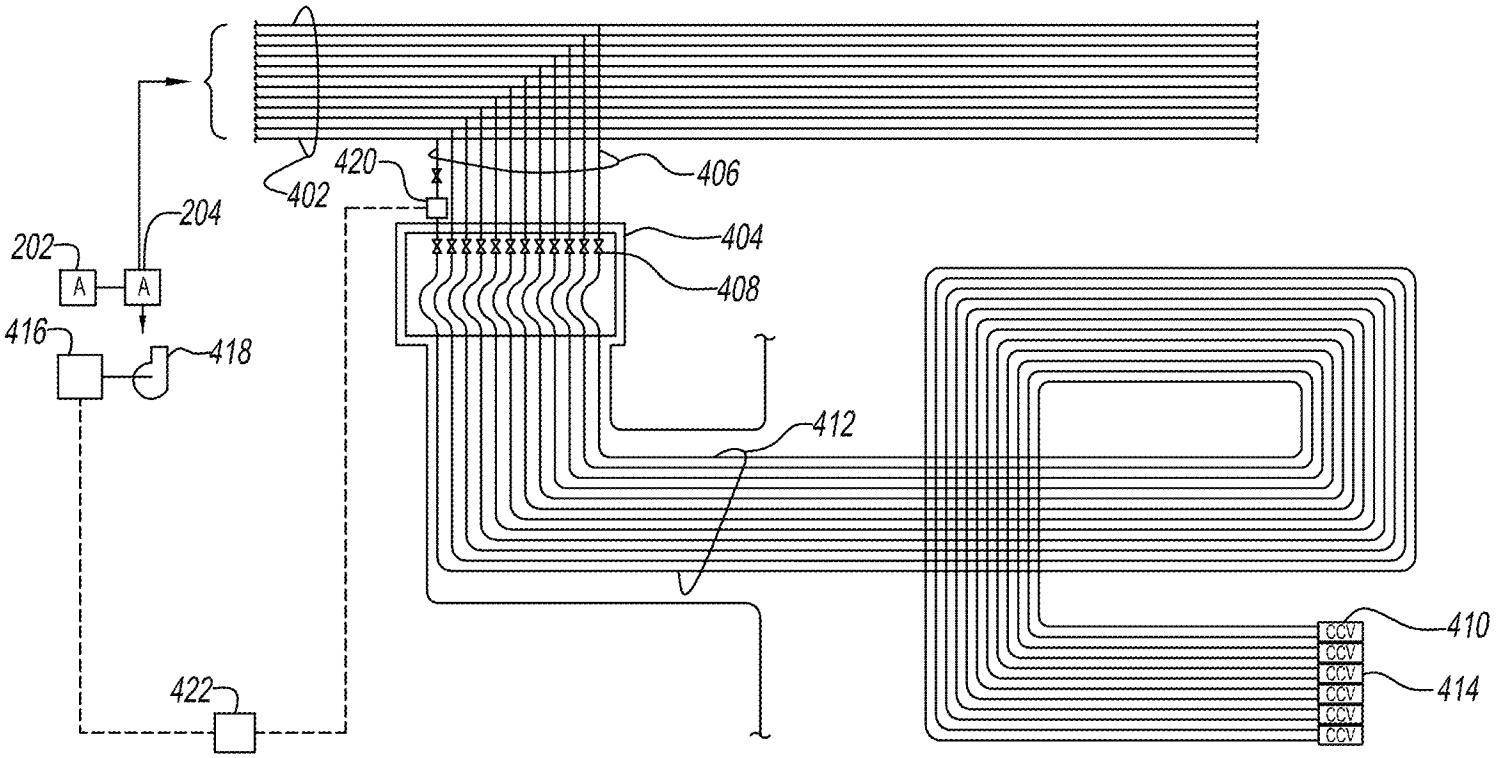
FIG. 4 depicts in detail a paint distribution system of this disclosure having a spray station paint box and robot color change assemblies, including a circulating pump, flow meter, and programmable logic controller (PLC), where vehicle frames are coated including "graduated" piping and pig launching/receiving assemblies.

A robot spray station drop design of this disclosure is shown in FIG. 4. This is for six (6) colors only. However, more colors are typically used. The supply lines and return lines, totally twelve (12), one (1) supply and return the six (6) colors from and to the tanks 202 and 204. The tubing 402 is graduated in size to maintain a minimum fluid velocity in the tubes. This tubing is generally stainless steel. There is a spray station paint box 404 where each color is brought in using a spray station drop tubing 406, and returned via a return tube for each color. The spray station drop tubing 406 also includes ball valves 408 for paint isolation purposes. From the ball valves 408, two (2) hoses (one supply and one return) for each color then goes to the robot color change assembly 410. Thus, FIG. 4 shows a total of twelve (12) robot paint supply and return hoses 412, two (one supply and one return) for each color. FIG. 4 also shows six (6) color change valves (CCV) at 414.

Thus, the function of the paint distribution system is to supply paint from tanks 202 and 204 to robot color change assembly 410 reliably so that the robots can paint the auto bodies with high quality, high yield and at a rapid pace. There are many requirements and considerations, for example, more than twenty (20) colored paints must be circulated and travel very long distances around the clock; paint applicator equipment requires a specified fluid pressure in order to spray the paint; the lines also require a minimum fluid velocity; the paints can have variable paint viscosities, and the design must accommodate these variable viscosities; and the paint material integrity must be maintained.

The paint distribution system includes a motor 416, circulating pump 418, a flow meter 420 located at a specific distant drop on a supply line, and a programmable logic controller (PLC) 422. The PLC 422 has a logic system that provides control of one or more parameters of the paint within a predetermined range in real time. The one or more parameters include one or more of velocity, flow rate, shear rate, temperature or pressure values for the paint in the paint distribution system.

The PLC 422 manages the circulating pump 418 function. The PLC 422 can also be interfaced with other components for managing the paint distribution system operations. Optionally, a proportional-integral-derivative (PID) controller can be used. The control can be stand alone, in the pump controller, or a PLC.

Referring to FIG. 4, the PLC 422 is provided for pressure supply to the paint distribution system. The PLC 422 receives a signal from the flow meter 420 containing measurements of one or more parameters of a paint in the paint distribution system. The PLC 422 sends a signal to the circulating pump 418 to maintain or adjust circulating pump settings to control supply pressure to the paint distribution system. Next signal the PLC 422 sends to the flow meter 420 is that it is ready to accept new measurements of paint parameters. The PLC 422 receives a signal from the flow meter 420 containing new measurements of one or more parameters of a paint in the paint distribution system. The PLC 422 sends a signal to the circulating pump 418 to maintain or adjust circulating pump settings to control supply pressure to the paint distribution system. The PLC 422 has a logic system that provides continuous control of one or more parameters of the paint within a predetermined range in real time.

Figure 5:
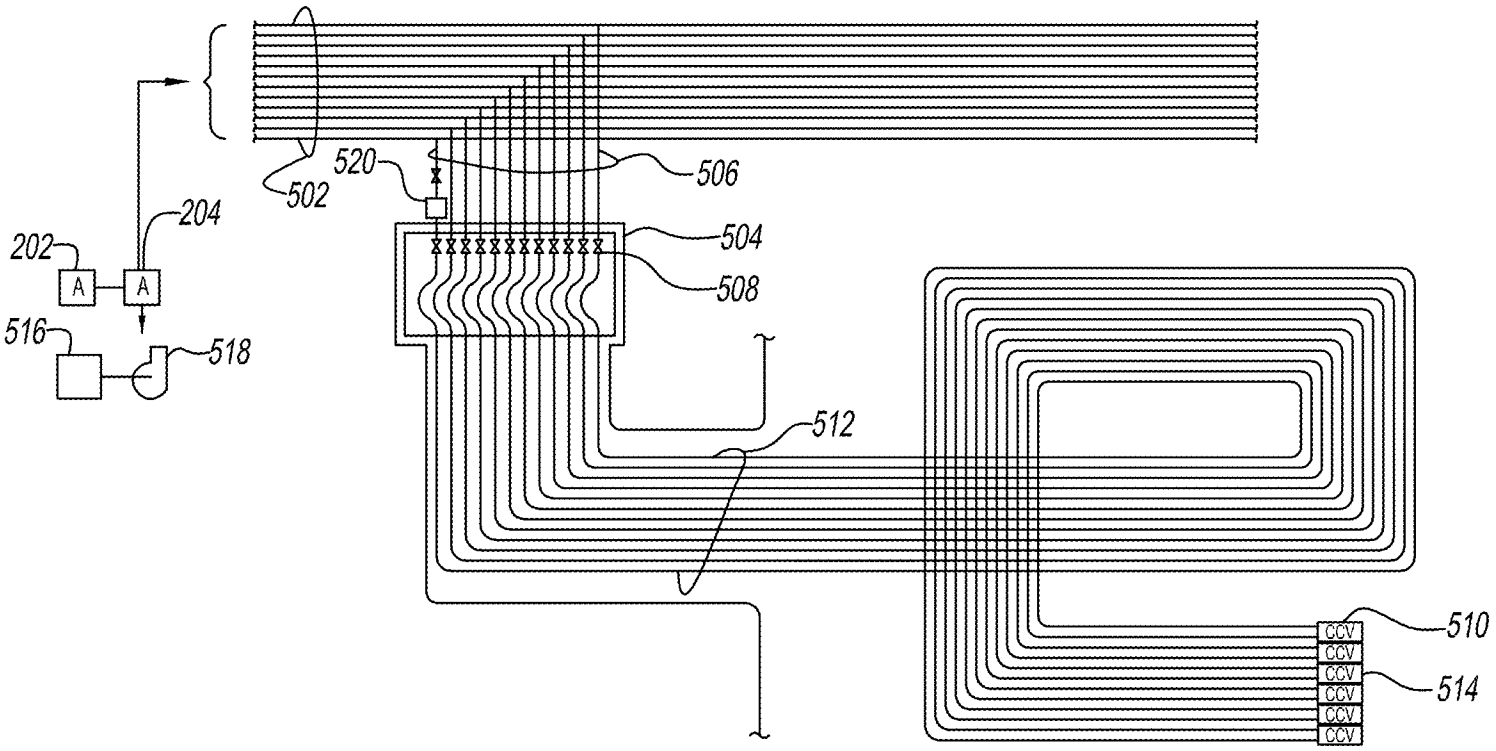
FIG. 5 depicts in detail a paint distribution system of this disclosure having a spray station paint box and robot color change assemblies, including a circulating pump, and flow meter, in which circulating pump settings are maintained or adjusted manually to control supply flow and pressure to the paint distribution system, and where vehicle frames are coated including "graduated" piping and pig launching/receiving assemblies.

A robot spray station drop design of this disclosure is shown in FIG. 5. This is for six (6) colors only. However, more colors are typically used. The supply lines and return lines, totally twelve (12), one (1) supply and return the six (6) colors from and to the tanks 202 and 204. The tubing 502 is graduated in size to maintain a minimum fluid velocity in the tubes. This tubing is generally stainless steel. There is a spray station paint box 504 where each color is brought in using a spray station drop tubing 506, and returned via a return tube for each color. The spray station drop tubing 506 also includes ball valves 508 for paint isolation purposes. From the ball valves 508, two (2) hoses (one supply and one return) for each color then goes to the robot color change assembly 510. Thus, FIG. 5 shows a total of twelve (12) robot paint supply and return hoses 512, two (one supply and one return) for each color. FIG. 5 also shows six (6) color change valves (CCV) at 514.

Thus, the function of the paint distribution system is to supply paint from tanks 202 and 204 to robot color change assembly 510 reliably so that the robots can paint the auto bodies with high quality, high yield and at a rapid pace. There are many requirements and considerations, for example, more than twenty (20) colored paints must be circulated and travel very long distances around the clock; paint applicator equipment requires a specified fluid pressure in order to spray the paint; the lines also require a minimum fluid velocity; the paints can have variable paint viscosities, and the design must accommodate these variable viscosities; and the paint material integrity must be maintained.

The paint distribution system includes a motor 516, circulating pump 518, and a flow meter 520 located at a specific distant drop on a supply line. The motor 516 and circulating pump 518 can be a pneumatic, hydraulic or electric motor/pump. The flow meter 520 is visually monitored by an operator. The circulating pump 518 is adjusted manually by the operator based on data from the flow meter 520. The operator maintains or adjusts manually circulating pump settings to control supply flow and pressure to the paint distribution system, and thereby maintain or adjust the one or more parameters of the paint within a predetermined range.

For purposes of this disclosure, paint is used broadly to include water and solvent borne paints, particularly both metallic and non-metallic paints, all of which may pass through the paint distribution system. In addition, those skilled in the art will appreciate that other paint materials may also be included in the paint distribution system of this disclosure, such as base coats, primers applied prior to the paint coat, and finishers and clear coats, which can be applied subsequent to the paint applications. The paint materials can contain binders or binder mixtures, which are present in solution in suitable solvent mixtures, as well as pigment mixture and extender mixtures.

Figure 6:
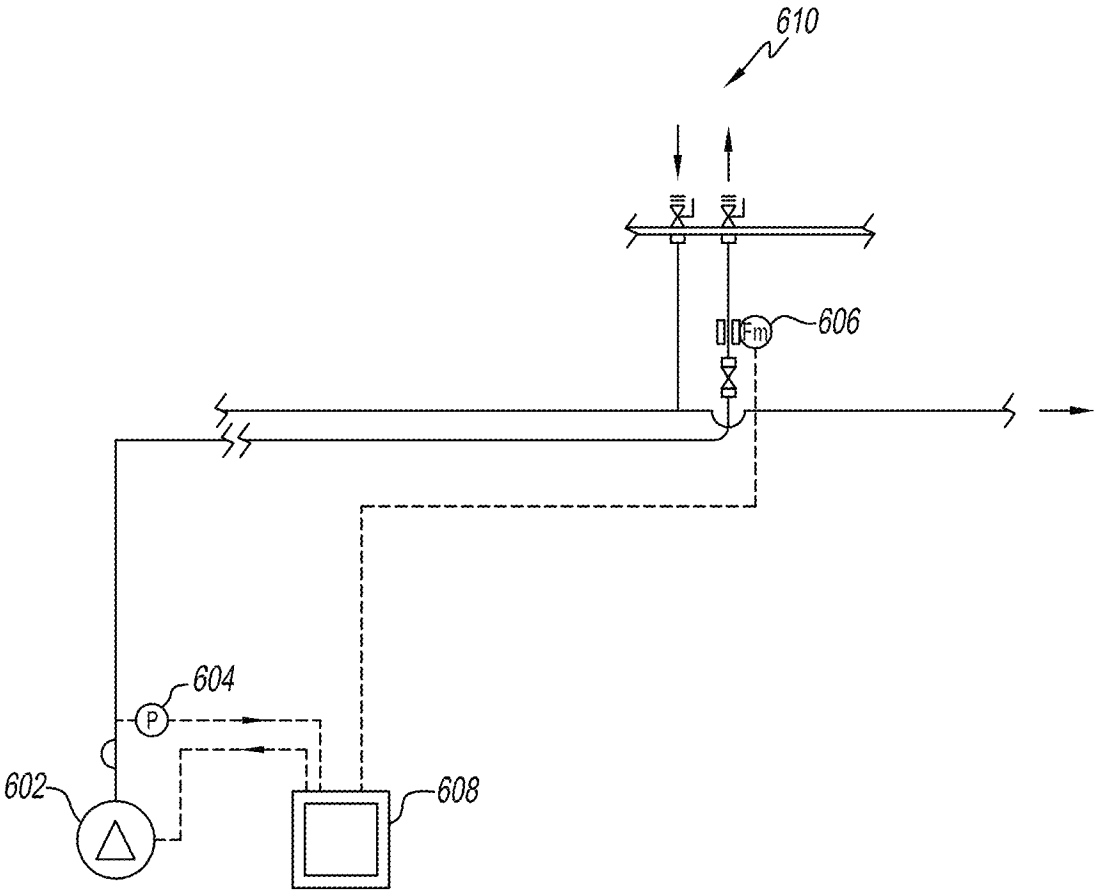
FIG. 6 depicts the interaction of a circulating pump, flow meter, pressure transmitter, and programmable logic controller (PLC) in the paint distribution system of this disclosure.

FIG. 6 shows the interaction of a circulating pump, flow meter, pressure transmitter, and programmable logic controller (PLC) in the paint distribution system of this disclosure.

The paint distribution system includes circulating pump 602, a pressure transmitter 604, a flow meter 606 located at a specific distant paint drop 610 on a supply line, and a programmable logic controller (PLC) 608. The PLC 608 has a logic system that provides control of one or more parameters of the paint within a predetermined range in real time. The one or more parameters include one or more of velocity, flow rate, shear rate, temperature or pressure values for the paint in the paint distribution system.

The PLC 608 manages the circulating pump 602 function. The PLC 608 can also be interfaced with other components for managing the paint distribution system operations. Optionally, a proportional-integral-derivative (PID) controller can be used. The control can be stand alone, in the pump controller, or a PLC.

Referring to FIG. 6, the PLC 608 is provided for pressure supply to the paint distribution system. The PLC 608 receives signals from the flow meter 606 and pressure transmitter 604 containing measurements of one or more parameters of a paint in the paint distribution system (e.g., paint flow rate and paint supply pressure). The PLC 608 sends a signal to the circulating pump 602 to maintain or adjust circulating pump settings to control supply pressure to the paint distribution system. Next signal the PLC 608 sends to the flow meter 606 and pressure transmitter 604 is that it is ready to accept new measurements of paint parameters. The PLC 608 receives signals from the flow meter 606 and pressure transmitter 604 containing new measurements of one or more parameters (e.g., paint flow rate and paint supply pressure) of a paint in the paint distribution system. The PLC 608 sends a signal to the circulating pump 602 to maintain or adjust circulating pump settings to control supply pressure to the paint distribution system. The PLC 608 has a logic system that provides continuous control of one or more parameters of the paint within a predetermined range in real time.

Figure 7:
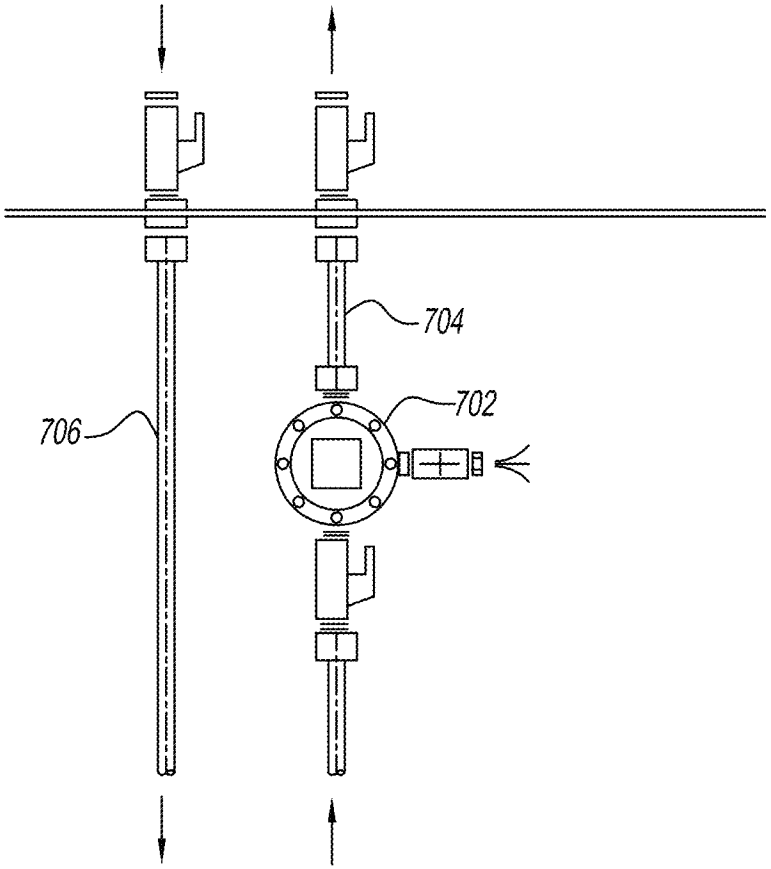
FIG. 7 depicts an illustrative flow meter positioned on a paint supply line in the paint distribution system of this disclosure.

FIG. 7 depicts an illustrative flow meter 702 positioned on a paint supply line 704 in the paint distribution system of this disclosure. Paint return line 706 is also shown in FIG. 7.

Figure 8:
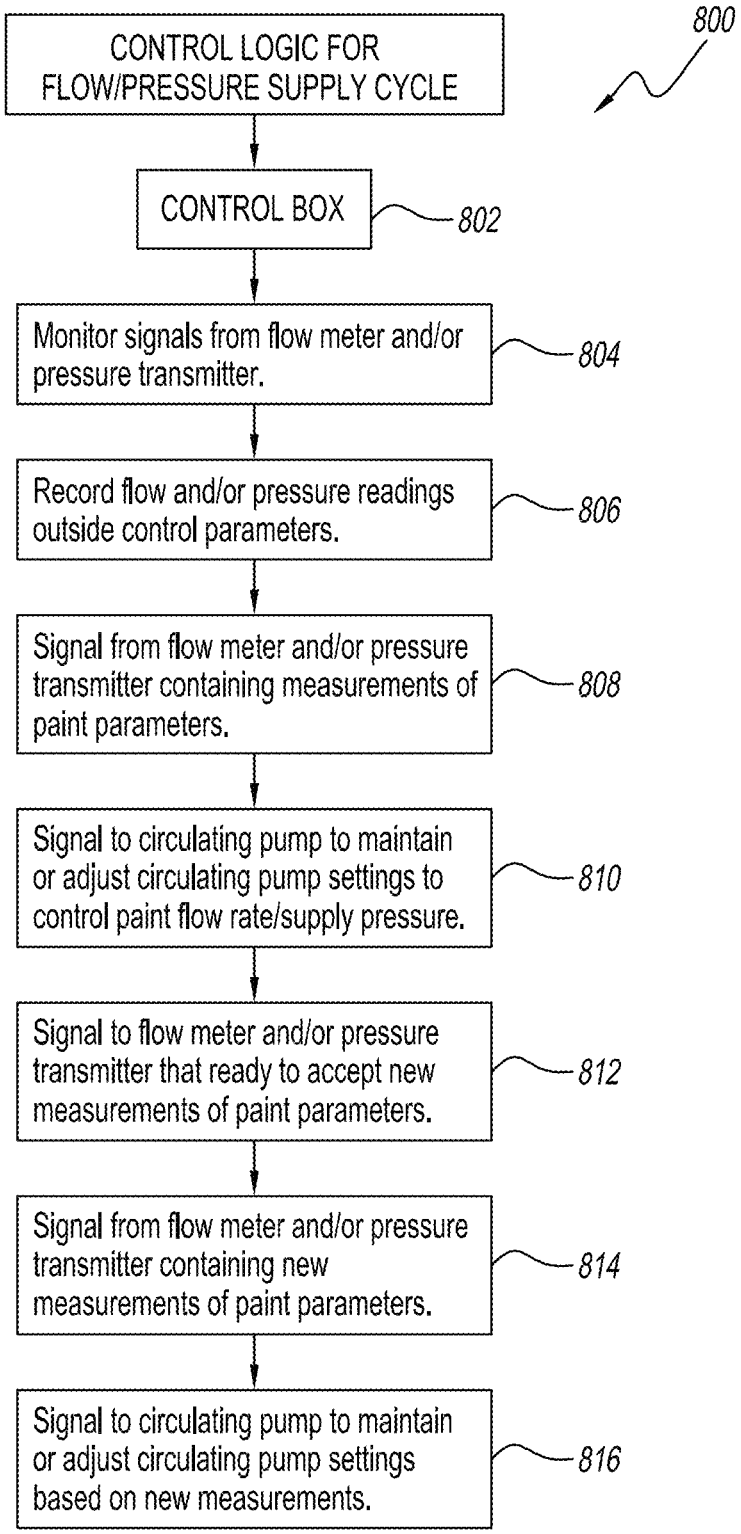
FIG. 8 depicts an illustrative logic control diagram for pressure supply to a paint distribution system that includes a circulating pump and a measuring device (e.g., flow meter and pressure transmitter) in accordance with this disclosure.

FIG. 8 depicts an illustrative logic control diagram for pressure supply to a paint distribution system that includes a circulating pump and measuring devices (i.e., flow meter and pressure transmitter) in accordance with this disclosure. The illustrative logic system provides control of one or more parameters of the paint within a predetermined range in real time. The one or more parameters include one or more of velocity, flow rate, shear rate, temperature or pressure values for the paint in the paint distribution system.

The control box 802 manages the circulating pump function. The control box 802 monitors signals from the flow meter and/or pressure transmitter in 804, and records flow and/or pressure readings outside control parameters in 806. The flow meter is the master loop, and pressure is the slave loop. The control box 802 can also be interfaced with other components for managing the paint distribution system operations.

Referring to FIG. 8, an illustrative control logic system 800 is provided for pressure supply to a paint distribution system. The control box 802 receives signals from the flow meter and pressure transmitter containing measurements of one or more parameters (e.g., paint flow rate and paint supply pressure) of a paint in the paint distribution system, which it receives in 808. The control box 802 sends a signal to the circulating pump to maintain or adjust circulating pump settings to control supply pressure to the paint distribution system which it sends in 810. Next signal the control box 802 sends to the flow meter and pressure transmitter is that it is ready to accept new measurements of paint parameters which it sends in 812. The control box 802 receives signals from the flow meter and pressure transmitter containing new measurements of one or more parameters (e.g., paint flow rate and paint supply pressure) of a paint in the paint distribution system, which it receives in 814. The control box 802 sends a signal to the circulating pump to maintain or adjust circulating pump settings to control supply pressure to the paint distribution system which it sends in 816. The illustrative logic system provides continuous control of one or more parameters of the paint within a predetermined range in real time.

Alternatively, with no PLC, the flow meter can be visually monitored by an operator. The circulating pump is adjusted manually by the operator based on data from the flow meter. The operator maintains or adjusts manually circulating pump settings to control supply flow and pressure to the paint distribution system, and thereby maintain or adjust the one or more parameters of the paint within a predetermined range.

Figure 9:
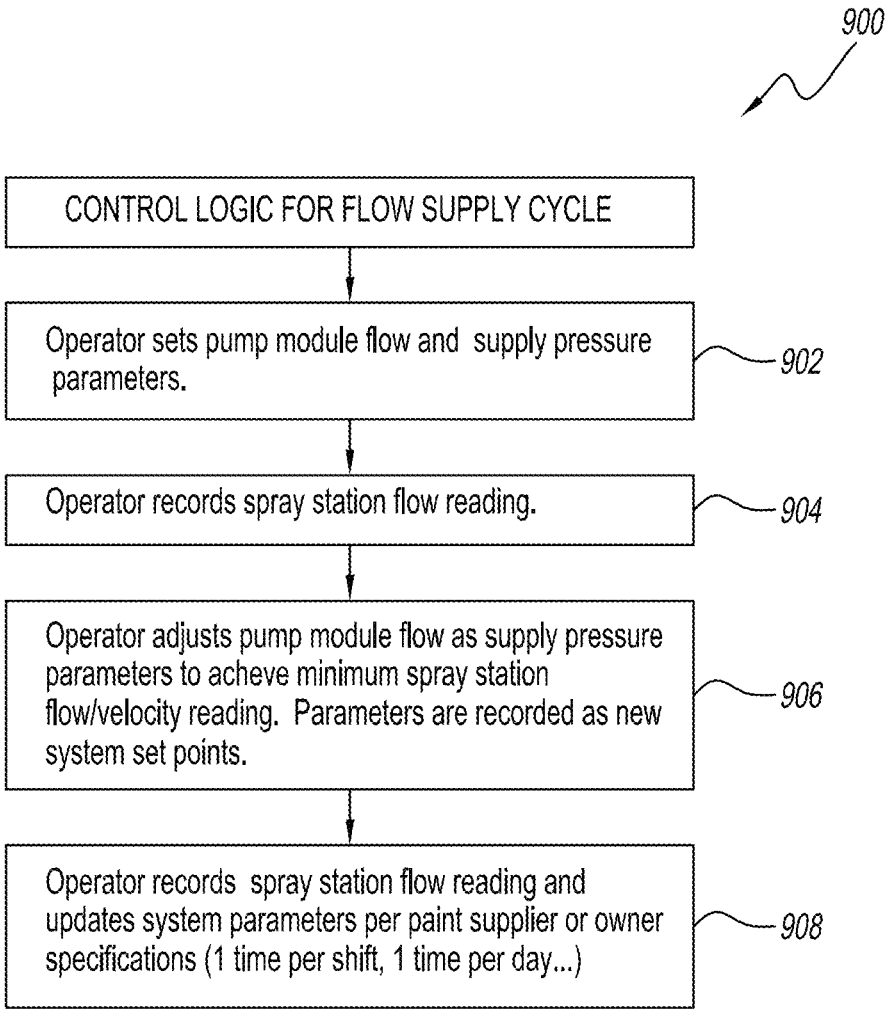
FIG. 9 depicts an illustrative logic control diagram for a flow supply cycle in a paint distribution system in accordance with this disclosure.

FIG. 9 depicts an illustrative logic control diagram for flow supply cycle in accordance with this disclosure. The illustrative logic system provides control of one or more parameters of the paint within a predetermined range in real time. The one or more parameters include one or more of velocity, flow rate, shear rate, temperature or pressure values for the paint in the paint distribution system.

Referring to FIG. 9, an illustrative control logic system 900 is provided for pressure supply to a paint distribution system. An operator sets pump module flow and supply pressure parameters in 902. The operator records spray station flow readings in 904. The operator then adjusts the pump module flow as supply pressure parameters to achieve minimum spray station flow/velocity readings in 906. The operator records the spray station flow readings and updates system parameters per paint supplier or owner specifications (e.g., 1 time per shift, 1 time per day, etc.). The illustrative control logic system 900 provides control of one or more parameters of the paint within a predetermined range.

The paint distribution design of this disclosure is flexible enough to handle a range of supply pressures. This gives a lot of flexibility for the paint distribution system designers. The paint distribution design of the present disclosure covers pump supply pressures from 0 to about 300 psi. More preferably, the design covers supply pressures from 0 to about 200 psi. The design of the present disclosure covers flow rates from 0 to 30 gpm. More preferably, the design covers flow rates from 0 to about 9 gpm.

The paint distribution design of this disclosure includes in line flow control/measurement system (e.g., one or more flow meters, pressure transmitters, and the like).

The flow meter is preferably located on a specific distant paint supply line drop from the circulating pump. The flow meter measures/monitors paint spray station flow rate for velocity and shear rate confirmation. Illustrative flow meters useful in the paint distribution system of this disclosure include, for example, ultrasonic, coriolis mass, magnetic, and the like. Preferably, a flow meter is used that does not interfere with the paint flow.

The paint distribution design of this disclosure optionally includes a pressure transmitter. The pressure transmitter is preferably located on a paint supply line. The pressure transmitter measures/monitors paint supply pressure.

The paint distribution design of this disclosure may also include an in line temperature control apparatus. It may be in a form of a standard tube and tube or plate and frame heat exchanger.

In addition, the paint distribution design of this disclosure may also contain appropriate filters for paint filtration.

Further, the paint distribution design of this disclosure can include sensors. The sensors can measure the property characteristics of the paint as it flows through the paint distribution system and communicate this information to a controller.

The paint distribution design of this disclosure presents a paint distribution system that is balanced for optimum circulation velocity. The target range is between about 0.1 to about 2.0 feet per second with a preferred velocity requirement of between about 0.5 to about 1.0 fps. This velocity must be maintained while achieving the pressure requirement of the system.

Circulating pumps useful in this disclosure are configured to provide the mechanism by which to force paint from the one or more reservoir tanks and day tanks, through the one or more spray station paint assemblies and the one or more paint color change assemblies, to the one or more paint application station assemblies, and finally back to either the one or more reservoir tanks and day tanks or another holding facility. Illustrative circulating pumps include, for example, pneumatic, hydraulic and electric pumps. The pumps can be coupled with a respective motor (e.g., a variable frequency drive motor) with an associated motor control allowing the pump to change or alter the amount of pressure it exerts on the paint distribution system.

In an exemplary embodiment, the paint is supplied from the one or more reservoir tanks and day tanks through piping at a pressure ranging from between about 100 psi to about 300 psi or greater. When the paint is passed to one or more paint application station assemblies and released, a pressure drop in the system occurs. When this happens, one or more circulating pumps can be signaled to increase the pressure in the paint distribution system to maintain the flow of paint within the upper and lower limits of a predetermined range.

The circulating pumps may include a direct current motor drive system. Such a motor control includes a microprocessor whereby the motor control may be adjusted to maintain the paint in the paint distribution system to have a set of parameters which remain within the predetermined range. The motor speed and current during pumping can be monitored using suitable sensors which provide an indication of the pressure and/or flow rate within the paint distribution system. In another exemplary embodiment, the paint distribution system can include more than one pump to pressurize the circulation system (e.g., multiple pumps in the paint distribution system).

In order to dispense the paint to designated parts, one or more paint application station assemblies are used to apply the paint to such parts. The one or more paint application station assemblies extend from the one or more paint color change valves. These one or more paint application station assemblies may include spray guns, bells, or application devices attached to the robots which expel the paint from the system. Thus, spray application devices can be either automated or manual in nature. In many applications today both robots and individuals apply paint to the respective parts for automobiles. For example, in the automotive industry body parts for various vehicles are generally painted both automatically with robots and manually with spray guns, in order to ensure substantially complete coverage of the part.

The properties of the paint as it flows through the paint distribution system of this disclosure include a set of parameters which defines conditions in the operating system. The set of parameters can include one or more of velocity, flow rate, temperature or pressure values for the paint in the operating system. These parameters influence the property characteristics of the paint as it flows through the operating paint distribution system.

One or more controllers oversee the paint distribution system and typically have at least one input, configured to receive the input data signals, and at least one output, configured to transmit output data signals. The output data signals include instructions to maintain the set of parameters associated with the paint while it is in the operating system so that the set of parameters stay within a predetermined range.

In one exemplary embodiment, the output data signals include one or more of velocity, flow rate, temperature or pressure values for the paint. In one exemplary embodiment, the output data signal is speed, where the speed can be considered either high or low, for example, this instructs a circulating pump to maintain a given pressure within the operating system. The predetermined range includes an upper and a lower limit for the values defined in the set of parameters. This predetermined range can be set by the user or operator of the paint distribution system in order to maintain the characteristics and/or quality of the paint within a desired specification. For example, if any changes in the pressure or flow rate occurred in the paint distribution system, such alterations could be regulated and controlled, thus, returning the paint to within its desired specification having a set of parameters within its predetermined ranges.

In another example, an input data signal having the set of parameters is transmitted to the controller. When the input data signal is received, the controller generates output data signals. The output data signals are transmitted to, for example, a circulating pump in the operating paint distribution system. The circulating pump is instructed with the output data signal to maintain the set of parameters within a predetermined range.

In another exemplary embodiment, the one or more controllers include a plurality of inputs and outputs, allowing for additional input or output data signals to be sent or generated. In one particular embodiment, the controller is a process logic control (PLC). In another exemplary embodiment, the one or more controllers may also include one or more computers having associated software, wherein the one or more computers provide the user or operator the ability to make changes to the designated programming, thus introducing more flexibility into the system. Moreover, the one or more computers can be accessed remotely through a network which allows monitoring and control of the circulation system from various locations.

An illustrative controller useful in the paint distribution system of this disclosure is described, for example, in U.S. Pat. No. 6,090,450, the disclosure of which is incorporated herein by reference in its entirety.

In another exemplary embodiment, the paint distribution system of this disclosure further comprises one or more paint booths. The one or more paint booths generally include a housing in which parts can pass or are maintained while the paint is applied to the particular parts or components as they pass through a housing. Spray application devices are usually connected by supply ducts, such as hoses, to the paint supply in the paint booths. In an exemplary embodiment, paint is applied to parts of a vehicle while they travel along an assembly line where a plurality of robots can be positioned along opposite sides of the assembly line as it passes through the paint booth. In addition, manual spray guns may be used to paint some portions of the vehicle, particularly those which pose difficult-to-reach locations.

As described above, the paint distribution system may include more than one paint, such that one paint may exist in one hose from the paint color change assembly, while another one may exist in a second hose from the paint color change assembly. Thus, multiple paints can be utilized within a single paint booth. However, the system can also be arranged so that multiple booths can be used to provide locations for additional paints to be applied.

The paint distribution system of this disclosure is constructed of material capable of containing the paint. For example, it can be comprised of metal or plastic components, such that the paint does not substantially react physically or chemically with the material in any way to substantially affect the paint's composition or quality. Stainless steel is commonly used for various piping and fittings that make up the paint distribution system.

Additional preferred embodiments of this disclosure are described in the clauses below.

Clause 1. A paint distribution system comprising:

at least one paint reservoir;

at least one spray station paint assembly;

a plurality of paint circulation lines disposed between the paint reservoir and the spray station paint assembly;

at least one paint color change assembly;

a plurality paint supply lines in fluid communication between the spray station paint assembly and the paint color change assembly;

at least one circulating pump configured to supply pressure to the paint distribution system; the circulating pump having at least one input, configured to receive input data signals;

at least one measuring device for measuring one or more parameters of a paint; the measuring device having at least one input, configured to receive input data signals, and having at least one output, configured to transmit output data signals; the measuring device positioned on a paint supply line in fluid communication with a paint color change assembly; and one or more controllers having at least one input, configured to receive input data signals, and at least one output, configured to transmit output data signals;

wherein one or more output data signals are transmitted from the measuring device to the controller, the controller generates one or more output data signals based on one or more input data signals received from the measuring device, and the output data signals from the controller are transmitted to the circulating pump to maintain or adjust circulating pump settings to control supply pressure to the paint distribution system, and thereby maintain or adjust the one or more parameters of the paint within a predetermined range in real time.

Clause 2. The paint distribution system of clause 1 wherein, for the measuring device positioned on the paint supply line in fluid communication with the paint color change assembly, the paint supply line and paint color change assembly are more distant, in fluid communication, from the circulating pump than other paint supply lines and paint color change assemblies of the paint distribution system.

Clause 3. The paint distribution system of clause 1 wherein the one or more parameters include one or more of velocity, flow rate, shear rate, temperature or pressure values for the paint in the paint distribution system.

Clause 4. The paint distribution system of clause 1 wherein the measuring device is a flow meter.

Clause 5. The paint distribution system of clause 1 wherein the measuring device is a pressure transmitter.

Clause 6. The paint distribution system of clause 1 wherein the at least one spray station paint assembly is configured such that the number of paint supply lines in fluid communication between the spray station paint assembly and the paint color change assembly is equal to the number of paint circulation lines from the paint reservoir to the spray station paint assembly.

Clause 7. The paint distribution system of clause 1 wherein the number of the paint circulation lines disposed between the paint reservoir and the spray station paint assembly is about 2 to about 100, and wherein the number of paint supply lines in fluid communication between the spray station paint assembly and the paint color change assembly is about 2 to about 100.

Clause 8. The paint distribution system of clause 1 further comprising at least one paint application station assembly in fluid communication with the paint color change assembly.

Clause 9. The paint distribution system of clause 8 wherein the paint application station assembly comprises at least one robot spray assembly, at least one manual spray assembly, or a combination thereof.

Clause 10. The paint distribution system of clause 1 which is an automobile paint distribution system.

Clause 11. The paint distribution system of clause 1 wherein the one or more parameters of the paint are maintained or adjusted within a predetermined range to control color of the paint.

Clause 12. A paint distribution system comprising:

at least one paint reservoir;

at least one spray station paint assembly;

a plurality of paint circulation lines disposed between the paint reservoir and the spray station paint assembly;

at least one paint color change assembly;

a plurality paint supply lines in fluid communication between the spray station paint assembly and the paint color change assembly;

at least one circulating pump configured to supply flow and pressure to the paint distribution system; and at least one measuring device for measuring one or more parameters of a paint;

wherein the measuring device is positioned on a paint supply line in fluid communication with a paint color change assembly; wherein data generated by the measuring device is monitored manually; and wherein, based on data generated by the measuring device, circulating pump settings are maintained or adjusted manually to control supply flow and pressure to the paint distribution system, and thereby maintain or adjust the one or more parameters of the paint within a predetermined range.

Clause 13. The paint distribution system of clause 12 wherein, for the measuring device positioned on the paint supply line in fluid communication with the paint color change assembly, the paint supply line and paint color change assembly are more distant, in fluid communication, from the circulating pump than other paint supply lines and paint color change assemblies of the paint distribution system.

Clause 14. The paint distribution system of clause 12 wherein the one or more parameters include one or more of velocity, flow rate, shear rate, temperature or pressure values for the paint in the paint distribution system.

Clause 15. The paint distribution system of clause 12 wherein the measuring device is a flow meter.

Clause 16. The paint distribution system of clause 12 wherein the measuring device is a pressure transmitter.

Clause 17. The paint distribution system of clause 12 wherein the at least one spray station paint assembly is configured such that the number of paint supply lines in fluid communication between the spray station paint assembly and the paint color change assembly is equal to the number of paint circulation lines from the paint reservoir to the spray station paint assembly.

Clause 18. The paint distribution system of clause 12 wherein the number of the paint circulation lines disposed between the paint reservoir and the spray station paint assembly is about 2 to about 100, and wherein the number of paint supply lines in fluid communication between the spray station paint assembly and the paint color change assembly is about 2 to about 100.

Clause 19. The paint distribution system of clause 12 further comprising at least one paint application station assembly in fluid communication with the paint color change assembly.

Clause 20. The paint distribution system of clause 19 wherein the paint application station assembly comprises at least one robot spray assembly, at least one manual spray assembly, or a combination thereof.

Clause 21. The paint distribution system of clause 12 which is an automobile paint distribution system.

Clause 22. The paint distribution system of clause 12 wherein the one or more parameters of the paint are maintained or adjusted within a predetermined range to control color of the paint.

Clause 23. A paint distribution system comprising:

at least one paint reservoir; and at least one hydraulically balanced or graduated paint circulation system comprising:

at least one circulating pump configured to supply pressure to the paint distribution system; the circulating pump having at least one input, configured to receive input data signals;

at least one measuring device for measuring one or more parameters of a paint; the measuring device having at least one input, configured to receive input data signals, and having at least one output, configured to transmit output data signals; and one or more controllers having at least one input, configured to receive input data signals, and at least one output, configured to transmit output data signals;

wherein one or more output data signals are transmitted from the measuring device to the controller, the controller generates one or more output data signals based on one or more input data signals received from the measuring device, and the output data signals from the controller are transmitted to the circulating pump to maintain or adjust circulating pump settings to control supply pressure to the paint distribution system, and thereby maintain or adjust the one or more parameters of the paint within a predetermined range in real time.

Clause 24. A paint distribution system comprising:

at least one paint reservoir; and at least one hydraulically balanced or graduated paint circulation system;

wherein the at least one hydraulically balanced or graduated paint circulation system comprises:

at least one circulating pump configured to supply pressure to the paint distribution system; and at least one measuring device for measuring one or more parameters of a paint;

wherein data generated by the measuring device is monitored manually; and wherein, based on data generated by the measuring device, circulating pump settings are maintained or adjusted manually to control supply flow and pressure to the paint distribution system, and thereby maintain or adjust the one or more parameters of the paint within a predetermined range.

Clause 25. A method for supplying a paint for coating of a workpiece, the method comprising:

a) providing a paint distribution system comprising:

at least one paint reservoir;

at least one spray station paint assembly;

a plurality of paint circulation lines disposed between the paint reservoir and the spray station paint assembly;

at least one paint color change assembly;

a plurality paint supply lines in fluid communication between the spray station paint assembly and the paint color change assembly;

at least one circulating pump configured to supply pressure to the paint distribution system; the circulating pump having at least one input, configured to receive input data signals;

at least one measuring device for measuring one or more parameters of a paint; the measuring device having at least one input, configured to receive input data signals, and having at least one output, configured to transmit output data signals; the measuring device positioned on a paint supply line in fluid communication with a paint color change assembly; and one or more controllers having at least one input, configured to receive input data signals, and at least one output, configured to transmit output data signals;

wherein one or more output data signals are transmitted from the measuring device to the controller, the controller generates one or more output data signals based on one or more input data signals received from the measuring device, and the output data signals from the controller are transmitted to the circulating pump to maintain or adjust circulating pump settings to control supply pressure to the paint distribution system, and thereby maintain or adjust the one or more parameters of the paint within a predetermined range in real time;

b) circulating one or more colored paints through the paint distribution system; and c) coating the workpiece with the one or more colored paints.

Clause 26. The method of clause 25 wherein the workpiece is an automotive part.

Clause 27. The method of clause 25 wherein, for the measuring device positioned on the paint supply line in fluid communication with the paint color change assembly, the paint supply line and paint color change assembly are more distant, in fluid communication, from the circulating pump than other paint supply lines and paint color change assemblies of the paint distribution system.

Clause 28. The method of clause 25 wherein the one or more parameters include one or more of velocity, flow rate, shear rate, temperature or pressure values for the paint in the paint distribution system.

Clause 29. The method of clause 25 wherein the measuring device is a flow meter.

Clause 30. The method of clause 25 wherein the measuring device is a pressure transmitter.

Clause 31. The method of clause 25 wherein the at least one spray station paint assembly is configured such that the number of paint supply lines in fluid communication between the spray station paint assembly and the paint color change assembly is equal to the number of paint circulation lines from the paint reservoir to the spray station paint assembly.

Clause 32. The method of clause 25 wherein the number of the paint circulation lines disposed between the paint reservoir and the spray station paint assembly is about 2 to about 100, and wherein the number of paint supply lines in fluid communication between the spray station paint assembly and the paint color change assembly is about 2 to about 100.

Clause 33. The method of clause 25 wherein the paint distribution system further comprises at least one paint application station assembly in fluid communication with the paint color change assembly.

Clause 34. The method of clause 33 wherein the paint application station assembly comprises at least one robot spray assembly, at least one manual spray assembly, or a combination thereof.

Clause 35. The method of clause 25 wherein the paint distribution system is an automobile paint distribution system.

Clause 36. The method of clause 25 wherein the one or more parameters of the paint are maintained or adjusted within a predetermined range to control color of the paint.

Clause 37. A method for supplying a paint for coating of a workpiece, the method comprising:

a) providing a paint distribution system comprising:

at least one paint reservoir;

at least one spray station paint assembly;

a plurality of paint circulation lines disposed between the paint reservoir and the spray station paint assembly;

at least one paint color change assembly;

a plurality paint supply lines in fluid communication between the spray station paint assembly and the paint color change assembly;

at least one circulating pump configured to supply pressure to the paint distribution system; and at least one measuring device for measuring one or more parameters of a paint;

wherein the measuring device is positioned on a paint supply line in fluid communication with a paint color change assembly; wherein data generated by the measuring device is monitored manually; and wherein, based on data generated by the measuring device, circulating pump settings are maintained or adjusted manually to control supply flow and pressure to the paint distribution system, and thereby maintain or adjust the one or more parameters of the paint within a predetermined range;

b) circulating one or more colored paints through the paint distribution system; and c) coating the workpiece with the one or more colored paints.

Clause 38. The method of clause 37 wherein the workpiece is an automotive part.

Clause 39. The method of clause 37 wherein, for the measuring device positioned on the paint supply line in fluid communication with the paint color change assembly, the paint supply line and paint color change assembly are more distant, in fluid communication, from the circulating pump than other paint supply lines and paint color change assemblies of the paint distribution system.

Clause 40. The method of clause 37 wherein the one or more parameters include one or more of velocity, flow rate, shear rate, temperature or pressure values for the paint in the paint distribution system.

Clause 41. The method of clause 37 wherein the measuring device is a flow meter.

42. The method of clause 37 wherein the measuring device is a pressure transmitter.

Clause 43. The method of clause 37 wherein the at least one spray station paint assembly is configured such that the number of paint supply lines in fluid communication between the spray station paint assembly and the paint color change assembly is equal to the number of paint circulation lines from the paint reservoir to the spray station paint assembly.

Clause 44. The method of clause 37 wherein the number of the paint circulation lines disposed between the paint reservoir and the spray station paint assembly is about 2 to about 100, and wherein the number of paint supply lines in fluid communication between the spray station paint assembly and the paint color change assembly is about 2 to about 100.

Clause 45. The method of clause 37 wherein the paint distribution system further comprises at least one paint application station assembly in fluid communication with the paint color change assembly.

Clause 46. The method of clause 45 wherein the paint application station assembly comprises at least one robot spray assembly, at least one manual spray assembly, or a combination thereof.

Clause 47. The method of clause 37 wherein the paint distribution system is an automobile paint distribution system.

Clause 48. The method of clause 37 wherein the one or more parameters of the paint are maintained or adjusted within a predetermined range to control color of the paint.

Clause 49. A method for supplying a paint for coating of a workpiece, the method comprising:

a) providing a paint distribution system comprising:

at least one paint reservoir; and at least one hydraulically balanced or graduated paint circulation system;

wherein the at least one hydraulically balanced or graduated paint circulation system comprises:

at least one circulating pump configured to supply pressure to the paint distribution system; the circulating pump having at least one input, configured to receive input data signals;

at least one measuring device for measuring one or more parameters of a paint; the measuring device having at least one input, configured to receive input data signals, and having at least one output, configured to transmit output data signals; and one or more controllers having at least one input, configured to receive input data signals, and at least one output, configured to transmit output data signals;

wherein one or more output data signals are transmitted from the measuring device to the controller, the controller generates one or more output data signals based on one or more input data signals received from the measuring device, and the output data signals from the controller are transmitted to the circulating pump to maintain or adjust circulating pump settings to control supply pressure to the paint distribution system, and thereby maintain or adjust the one or more parameters of the paint within a predetermined range in real time;

b) circulating one or more colored paints through the paint distribution system; and c) coating the workpiece with the one or more colored paints.

Clause 50. A method for supplying a paint for coating of a workpiece, the method comprising:

a) providing a paint distribution system comprising:

at least one paint reservoir; and at least one hydraulically balanced or graduated paint circulation system;

wherein the at least one hydraulically balanced or graduated paint circulation system comprises:

at least one circulating pump configured to supply pressure to the paint distribution system; and at least one measuring device for measuring one or more parameters of a paint;

wherein data generated by the measuring device is monitored manually; and wherein, based on data generated by the measuring device, circulating pump settings are maintained or adjusted manually to control supply flow and pressure to the paint distribution system, and thereby maintain or adjust the one or more parameters of the paint within a predetermined range;

b) circulating one or more colored paints through the paint distribution system; and c) coating the workpiece with the one or more colored paints.

The foregoing description of embodiments is presented for the purpose of illustration and description and is not meant to limit the present disclosure in any form. Many modifications are possible.

Although the present disclosure is applicable to paints in particular, it can be applied to various liquids and chemicals.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. A paint distribution system comprising:

at least two paint reservoirs;

at least one spray station paint assembly;

a plurality of paint circulation lines disposed between said paint reservoirs and said spray station paint assembly;

at least one paint color change assembly;

a plurality paint supply lines in fluid communication between the spray station paint assembly and the paint color change assembly;

at least one circulating pump configured to supply pressure to said paint distribution system; said circulating pump having at least one input, configured to receive input data signals;

a measuring device for measuring one or more parameters of a paint; said measuring device having at least one input, configured to receive input data signals, and having at least one output, configured to transmit output data signals; said measuring device positioned on a paint supply line in fluid communication with the at least one paint color change assembly; and one or more controllers having at least one input, configured to receive input data signals, and at least one output, configured to transmit output data signals;

wherein one or more output data signals are transmitted from said measuring device to said controller, said controller generates one or more output data signals based on one or more input data signals received from said measuring device, and the output data signals from said controller are transmitted to said circulating pump to maintain or adjust circulating pump settings to control supply pressure to said paint distribution system, and thereby maintain or adjust the one or more parameters of the paint within a predetermined range in real time; and wherein, for the measuring device positioned on the paint supply line in fluid communication with the paint color change assembly, the paint supply line in fluid color change assembly are more distant, in fluid communication, from the circulating pump than other paint supply lines and paint color change assemblies of said paint distribution system.

2. The paint distribution system of claim 1 wherein the one or more parameters include one or more of velocity, flow rate, shear rate, temperature or pressure values for the paint in the paint distribution system.

3. The paint distribution system of claim 1 wherein the measuring device is a flow meter.

4. The paint distribution system of claim 1 wherein the measuring device is a pressure transmitter.

5. The paint distribution system of claim 1 wherein the number of said paint circulation lines disposed between said paint reservoirs and said spray station paint assembly is 2 to 100, and wherein the number of paint supply lines in fluid communication between the spray station paint assembly and the paint color change assembly is 2 to 100.

6. The paint distribution system of claim 1 further comprising at least one paint application station assembly in fluid communication with the paint color change assembly.

7. The paint distribution system of claim 6 wherein the paint application station assembly comprises at least one robot spray assembly, at least one manual spray assembly, or a combination thereof.

8. The paint distribution system of claim 1 which is an automobile paint distribution system.

9. The paint distribution system of claim 1 wherein the one or more parameters of the paint are maintained or adjusted within a predetermined range to control color of the paint.

10. A method for supplying a paint for coating of a workpiece, said method comprising:

a) providing a paint distribution system comprising:

at least two paint reservoirs;

at least one spray station paint assembly;

a plurality of paint circulation lines disposed between said paint reservoirs and said spray station paint assembly;

at least one paint color change assembly;

a plurality paint supply lines in fluid communication between the spray station paint assembly and the paint color change assembly;

at least one circulating pump configured to supply pressure to said paint distribution system; said circulating pump having at least one input, configured to receive input data signals;

a measuring device for measuring one or more parameters of a paint; said measuring device having at least one input, configured to receive input data signals, and having at least one output, configured to transmit output data signals; said measuring device positioned on a paint supply line in fluid communication with the at least one paint color change assembly; and one or more controllers having at least one input, configured to receive input data signals, and at least one output, configured to transmit output data signals;

wherein one or more output data signals are transmitted from said measuring device to said controller, said controller generates one or more output data signals based on one or more input data signals received from said measuring device, and the output data signals from said controller are transmitted to said circulating pump to maintain or adjust circulating pump settings to control supply pressure to said paint distribution system, and thereby maintain or adjust the one or more parameters of the paint within a predetermined range in real time; and wherein, for the measuring device positioned on the paint supply line in fluid communication with the paint color change assembly, the paint supply line and the paint color change assembly are more distant, in fluid communication, from the circulating pump than the other paint supply lines and paint color change assemblies of said paint distribution system;

b) circulating one or more colored paints through the paint distribution system; and c) coating the workpiece with the one or more colored paints.

11. The method of claim 10 wherein the one or more parameters include one or more of velocity, flow rate, shear rate, temperature or pressure values for the paint in the paint distribution system.

12. The method of claim 10 wherein the measuring device is a flow meter.

13. The method of claim 10 wherein the measuring device is a pressure transmitter.

14. The method of claim 10 wherein the number of said paint circulation lines disposed between said paint reservoirs and said spray station paint assembly is 2 to 100, and wherein the number of paint supply lines in fluid communication between the spray station paint assembly and the paint color change assembly is 2 to 100.

15. The method of claim 10 wherein the paint distribution system further comprises at least one paint application station assembly in fluid communication with the paint color change assembly.

16. The method of claim 15 wherein the paint application station assembly comprises at least one robot spray assembly, at least one manual spray assembly, or a combination thereof.

17. The method of claim 10 wherein the paint distribution system is an automobile paint distribution system.

18. The method of claim 10 wherein the one or more parameters of the paint are maintained or adjusted within a predetermined range to control color of the paint.

* * * * *